United States Patent [19]

Bonilla et al.

[11] Patent Number: 4,922,555

[45] Date of Patent: May 8, 1990

[54] COMMODE PLUNGING SHIELD

[76] Inventors: Marco A. Bonilla; Linda M. Bonilla, both of 3783 Joplin Ave., San Diego, Calif. 92117

[21] Appl. No.: 321,713

[22] Filed: Mar. 10, 1989

[51] Int. Cl.[5] ..... E03D 11/00

[52] U.S. Cl. ..... 4/257; 4/300.3; 4/661

[58] Field of Search ..... 4/300.3, 661, 255–257

[56] References Cited

U.S. PATENT DOCUMENTS

| | | | |
|---|---|---|---|
| 2,529,587 | 11/1950 | Bates et al. | 4/257 |
| 2,617,996 | 11/1952 | Hoffman et al. | 4/257 |
| 2,980,919 | 4/1961 | Otto et al. | 4/300.3 |
| 3,193,845 | 7/1965 | Funk | 4/300.3 |
| 3,208,092 | 9/1965 | O'Leary | 4/253 X |
| 3,491,379 | 1/1970 | Parrish | 4/661 X |
| 3,644,943 | 2/1972 | Leonardo et al. | 4/255 |
| 4,186,451 | 2/1980 | Ruo | 4/255 |
| 4,458,368 | 7/1984 | Webb | 4/300.3 X |
| 4,469,358 | 9/1984 | Abbott | 4/661 X |
| 4,566,139 | 1/1986 | Jeng | 4/255 |
| 4,831,669 | 5/1989 | Edwards | 4/257 |

*Primary Examiner*—Charles E. Phillips
*Attorney, Agent, or Firm*—Leon Gilden

[57] ABSTRACT

A commode plunging shield apparatus is set forth including a convex shield formed with a planar lower rim in confronting relationship to a complementarily configured commode rim surface to position the shield in overlying relationship to the commode. A through-extending aperture directed through the crown of an uppermost surface of the commode in alignment with the commode drain pipe slidingly receives a commode plunger therethrough to align the plunger with the commode drain and directs splashing water interiorly of the concave interior surface of the shield to contain such water within the shield and the interior of the commode.

1 Claim, 1 Drawing Sheet

COMMODE PLUNGING SHIELD

BACKGROUND OF THE INVENTION

1. Field of the Invention

The field of invention relates to drain plunging apparatus, and more particularly pertains to a new and improved commode plunging shield apparatus wherein the same enables selective securement of a commode shield in overlying relationship to a commode to align a plunger with a commode drain.

2. Description of the Prior Art

The use of plungers of various types have been known in the prior art and utilized extensively. Such apparatus, however, have heretofore failed to take into account the splashing of water that is typical during a commode plunging operation to dislodge blockage within the drainage conduit of a commode. For example, U.S. Pat. No. 3,644,943 to Leonardo, et al., sets forth a device for clearing blockage from a commode comprising an elastomeric cup formed to a reciprocatable handle wherein a pressing member engages the cup adjacent a rim and acts between the rim and the base of the cup to bias the cup to an expanded position in use in a plunging operation. The patent is of interest relative to a plunging device, as utilized in a commode or other drain facility, but fails to provide an alignment shield as set forth by the instant invention to both align the plunger and contain splashing water within the shield.

U.S. Pat. No. 2,529,587 to Bates, et al., sets forth a cover for sealingly enclosing the opening of a commode to provide an airtight chamber during a pressure flushing of a commode. The Bates patent is of interest indicaating the use of a cover in an overlying relationship to a commode, but fails to provide an opening within the cover for slidingly receiving a plunging device in alignment with a drain of a commode.

U.S. Pat. No. 2,617,996 to Hoffman, et al., sets forth a shield for use with a commode wherein the shield is merely an open mesh-like guard for preventing or minimizing splashing of the commode water upwardly of the shield as the shield is positioned interiorly of the commode bowl.

U.S. Pat. No. 4,186,451 to Ruo sets forth a plastic plunging pump reciprocatably mounted within an associated cylinder for plunging of an associated drain pipe of a toilet and the like and is of interest relative to the field of invention in setting forth a further example of a plunging device.

U.S. Pat. No. 4,566,139 to Jeng sets forth a piston plunger for use with a commode or drain to set forth yet a further example of a device for use in the unclogging of water pipes and the like.

As such, it may be appreciated that there is a continuing need for a new and improved commode plunging shield apparatus as set forth by the instant invention which addresses both the problems of ease of use and effectiveness of construction, and in this respect, the present invention substantially fulfills this need.

SUMMARY OF THE INVENTION

In view of the foregoing disadvantages inherent in the known types of drain pipe plunging devices now present in the prior art, the present invention provides a commode plunging shield apparatus wherein the same way be readily secured in overlying relationship to the open end of a commode to align a plunging tool with the drain pipe of a commode and further contain splashing water interiorly of a concave surface of a shield. As such, the general purpose of the present invention, which will be described subsequently in greater detail, is to provide a new and improved commode plunging shield apparatus which has all the advantages of the prior art drainage plunging devices and none of the disadvantages.

To attain this, the present invention comprises a plunging shield of a general pear shaped external configuration formed with a planar shield rim surface of complementary configuration to the commode rim surface to align the shield in overlying relationship to the commode. A through-extending aperture positioned at the crown of the shield is aligned with the drainage pipe of the commode where the shield is positioned onto the commode. The shield includes a variety of mechanisms to align the shield including a downwardly extending skirt, a series of suctions cups, or an adhesive surface to secure the shield to the rim surface of the commode. The shield and its crown surface is positioned rearwardly of the medial portion of the shield and is formed with a downwardly tapering forward surface terminating in a forward end of the shield overlying the commode.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode plunging shield apparatus which has all the advantages of the prior art plunging apparatus and none of the disadvantages.

It is another object of the present invention to provide a new and improved commode plunging shield apparatus which may be easily and efficiently manufactured and marketed.

It is a further object of the present invention to provide a new and improved commode plunging shield apparatus which is of a durable and reliable construction.

An even further object of the present invention is to provide a new and improved commode plunging shield apparatus which is susceptible of a low cost of manufacture with regard to both materials and labor, and which accordingly is then susceptible of low prices of sale to the consuming public, thereby making such commode plunging shield apparatus economically available to the buying public.

Still yet another object of the present invention is to provide a new and improved commode plunging shield apparatus which provides in the apparatuses and methods of the prior art some of the advantages thereof, while simultaneously overcoming some of the disadvantages normally associated therewith.

Still another object of the present invention is to provide a new and improved commode plunging shield apparatus wherein the same is selectively securable in overlying relationship to a commode to align a plunging tool with a commode and a drain pipe and further capture splashing water interiorly of a concave interior surface of the shield.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to teh accompanying drawings and descriptive matter in which there is illustrated preferred embodiments of the invention.

BRIEF DESCRIPTION OF THE DRAWINGS

The invention will be better understood and objects other than those set forth above all become apparent when consideration is given to the following detailed description thereof. Such description makes reference to the annexed drawings wherein.

DESCRIPTION OF THE PREFERRED EMBODIMENT

Figure 1:
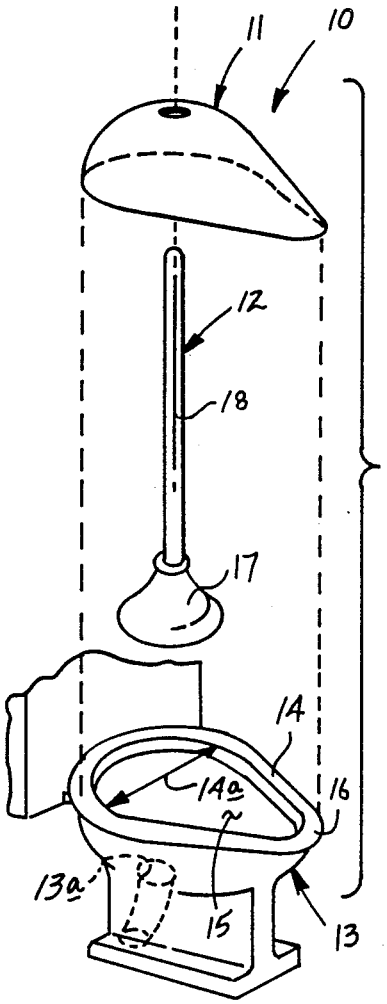
FIG. 1 is an isometric illustration of the instant invention, somewhat exploded, to illustrate the various parts of the invention, their configuration and relationship.

With reference now to the drawings, and in particular to FIGS. 1 to 5 thereof, a new and improved commode plunging shield apparatus embodying the principles and concepts of the present invention and generally designated by the reference numeral 10 will be described.

More specifically, the commode plunging shield apparatus of the instant invention essentially comprises a convex pear shaped shield 11 cooperative with a reciprocatably and orthogonally mounted commode plunger 12 to effect a plunging operation of a commode 13 and its associated drain conduit 13*a* positioned rearwardly of the commode bowl, as illustrated. The commode is formed with a commode rim surface 14, generally horizontally oriented relative to the commode, with an enlarged rear spacing 15 tapering forwardly to a forward nose 16 to provide a generally pear shaped configuration of the opening of the commode.

Included is a plunger 12 with a forwardly mounted flexible cup shaped plunger head 17 in an axially affixed elongate cylindrical shaft 18. The shaft 18 is received in a through-extending aperture 22 positioned through the crown or uppermost surface of the shield 11. The crown 19*a* is part of the outer surface 19 of the shield 11 and is of a convex configuration with an interior concave surface 20 in confronting relationship to the commode bowl.

It should be understood that the crown surface 19*a* of the outer surface 19 and the through-extending aperture 22 are aligned and overlying the drain conduit 13*a* of the commode 13 to enable a drain plunging operation to clear blockage within the drain conduit 13*a*. Accordingly, when the shield 11 is positioned over the commode, the plunger 12 will be in alignment with the conduit 13*a*. The shield 11 is formed with a planar shield rim surface of a predetermined geometric configuration including a rear width tapering to a forward nose and of complementary configuration to the commode rim surface 14.

Figure 4:
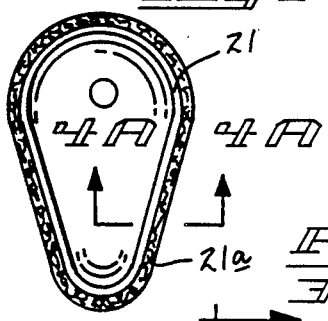
FIG. 4 is a bottom orthographic view of a further shield rim surface.
Figure 4A:
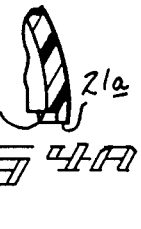
FIG. 4*a* is an orthographic view taken along the lines 4*a*—4*a* of FIG. 4 in the direction indicated by the arrows.
Figure 2:
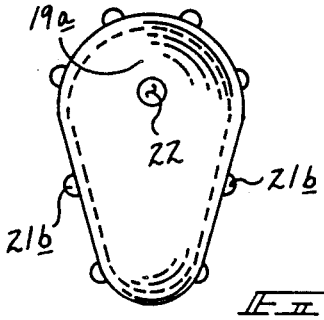
FIG. 2 is a top orthographic view of the instant invention.
Figure 3:
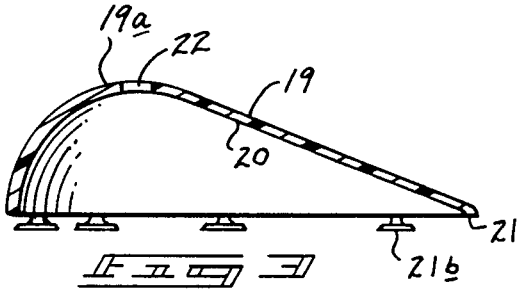
FIG. 3 is an orthographic view taken along the lines 3—3 of FIG. 2 in the direction indicated by the arrows.
Figure 5:
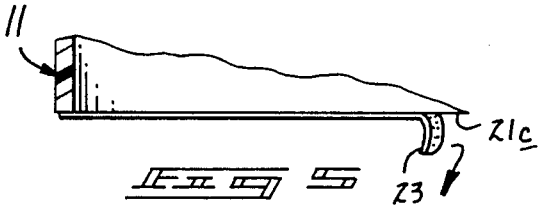
FIG. 5 is a further modification of a securement means associated with the shield rim surface.

Shield 11 and the confrontation and securement of its rim surface 21 to the commode rim surface 14 is effected per the organizations set forth in FIGS. 3, 4, and 5. FIG. 3 is illustrative of a series of suction cups 21*b* extending orthogonally downwardly to overlie and engage the commode rim surface 14 and thereby secure the shield 11 thereto. FIG. 4 illustrates a downwardly depending skirt 21*a* extending orthogonally relative to the shield rim surface 21 to enable the shield rim surface 21 to engage the commode rim surface 14 whereby the skirt 21*a* extending in an encircling manner about the rim surface 21 will engage the commode rim surface 14 and thereby align the shield 11 to the commode 13. Further, FIG. 5 illustrates an adhesive surface 21*c* with a peel-away strip 23 removably securable thereto to enable an adhesive interengagement of the shield 11 and the commode rim surface 14 to secure the shield 11 in situ to the commode 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode plunging shield apparatus for use with a commode wherein said commode includes a drain conduit and is formed with a horizontally disposed commode rim surface of a predetermined configuration in surrounding and overlying relationship to a commode bowl, said apparatus comprising, a shield including an exterior surface, and an interior surface, and a horizontally disposed shield rim surface arranged at lowermost terminal ends of said interior and exterior surfaces, and of a configuration equal to said predetermined configuration, and a through-extending aperture, and a plunger reciprocatably received within said aperture wherein said plunger includes an elongate cylindrical handle and an axially cup-shaped aligned plunger head at a lower terminal end of said handle, and securement means formed on said shield of secure the shield surface to the commode rim surface, and wherein said interior surface defines a concave interior surface and said exterior surface defines a convex exterior surface wherein said aperture is formed at an uppermost crown portion of the exterior surface, and said aperture is aligned with said drain conduit when said shield is secured to the commode, and wherein said securement means includes a continuous downwardly depending skirt orthogonally and integrally formed relative to the shield rim surface and defining a continuous external skirt surface aligned with said external surface to secure and align the commode rim surface relative to the shield rim surface, and wherein said rim surface is wholly positioned interiorly of said skirt, and wherein the shield is of a generally pear shaped configuration, and the commode rim surface is of a generally pear shaped configuration, and wherein the crown surface is oriented generally rearwardly of the shield and includes a forwardly tapering upper surface extending forwardly to a nose portion of the shield to overlie a forward nose portion of the commode.

* * * * *